United States Patent [19]

Shibanai et al.

[11] 4,255,249

[45] Mar. 10, 1981

[54] PROCESS FOR PRODUCTION OF OIL FROM OIL SAND

[75] Inventors: Ichiro Shibanai; Kouki Horikoshi, both of Tokyo; Nobuyuki Nakamura, Kunitachi, all of Japan

[73] Assignee: Kyoshin Co., Ltd., Tokyo, Japan

[21] Appl. No.: 50,990

[22] Filed: Jun. 22, 1979

[30] Foreign Application Priority Data

Apr. 5, 1979 [JP] Japan ..... 54-40304

[51] Int. Cl.[3] ..... C10G 1/00

[52] U.S. Cl. ..... 208/11 R; 208/11 LE

[58] Field of Search ..... 208/11 R, 11 LE, 308

[56] References Cited

U.S. PATENT DOCUMENTS

| | | | |
|---|---|---|---|
| 3,355,378 | 11/1967 | Cheema et al. | 208/308 |
| 3,567,791 | 3/1971 | Fuller | 208/308 |

FOREIGN PATENT DOCUMENTS

| | | | |
|---|---|---|---|
| 609876 | 12/1960 | Canada | 208/11 R |

*Primary Examiner*—Herbert Levine

*Attorney, Agent, or Firm*—Jordan and Hamburg

[57] ABSTRACT

A process for the production of oil from oil sand includes adding cyclodextrin or a starch decomposition product containing cyclodextrin to oil sand to convert petroleum in the oil sand to an inclusion compound and separating and collecting petroleum alone from the inclusion compound.

1 Claim, No Drawings

PROCESS FOR PRODUCTION OF OIL FROM OIL SAND

DETAILED DESCRIPTION OF THE INVENTION:

The present invention relates to a novel process for the production of oil from sand oil. More particularly, the invention relates to a process for the production of oil from oil sand, which comprises adding cyclodextrin or a starch decomposition product containing cyclodextrin to oil sand to form an inclusion compound from petroleum in the oil sand and cyclodextrin and recovering petroleum from this inclusion compound.

There has been known a process for recovering oil from oil sand according to the steam injection method. According to this process, high-temperature and high-pressure steam is injected under pressure into oil sand to separate petroleum from the oil sand. This process is, however, disadvantageous in that a large quantity of recovered petroleum should be used as a fuel necessary for the operation of a boiler.

We made researches with a view to developing a process for recovering oil from oil sand at a high efficiency with economical advantages, and as a result, it was found that cyclodextrin effectively reacts with petroleum contained in oil sand to include petroleum therein and form an inclusion compound. Based on this finding, we have now completed a process of the present invention for separating and recovering petroleum from oil sand.

By the term "oil sand" used in the present invention is meant a petroleum-containing rock or sand contained in a stratum called "oil pool" in the field of the science of the oil deposits.

Cyclodextrin that is added to oil sand in the present invention is a special dextrin in which molecules of D-glucose are bonded through $\alpha$-1,4 linkages to form a cyclic structure, and this compound is characterized in that it had a doughnut-like molecular structure and includes in the interior thereof voids having a diameter of 6 to 10 Å. Cyclodextrin includes three types, that is, $\alpha$-type, $\beta$-type and $\gamma$-type, differing in the number of D-glucose constituent units. Any type can be used in the present invention. Physical properties of cyclodextrin will now be described by reference to $\beta$-cyclodextrin.

It is a white crystalline powder and is represented by the molecular formula $(C_6H_{10}O_5)_7$. The molecular weight is 1135 and the melting point is 300° to 405° C. (decomposition).

A starch decomposition product containing cyclodextrin, that is used instead of cyclodextrin in the process of the present invention, can be prepared according to various methods. For example, such starch decomposition product is obtained as an intermediate product in the method for preparing cyclodextrin by reacting starch with a cyclodextrin-forming enzyme produced by a microorganism belonging to the genus Bacillus. This method will now be described in detail.

At first, the pH of a starch solution is adjusted to 10 to effect uniform gelatinization, and after cooling, the gelatinized starch is reacted with cyclodextrin glycosyltransferase, which is a fermentation product of a microorganism selected from Bacillus strain No. 13, Bacillus strain No. 17-1, Bacillus strain No. 38-2, Bacillus strain No. 135 and Bacillus strain No. 169 and has an optimum pH on the alkaline side and a high temperature stability. The liquid reaction mixture is heated to deactivate the enzyme, and the liquid reaction mixture is then cooled and the pH is adjusted to 5.0. Then, commercially available glucuamylase is added to the liquid reaction mixture to decompose the unreacted starting material.

Then, filtration is carried out according to customary procedures, and the filtrate is condensed so that the concentration of cyclodextrin is at least about 40%. When a small amount of cyclodextrin is added as a seed crystal to the condensate and it is allowed to stand still, cyclodextrin is separated and precipitated. The precipitate is recovered by filtration and dried to obtain $\beta$-cyclodextrin. The above filtrate is a cyclodextrin-containing starch decomposition product that is used in the process of the present invention (see Japanese Patent Publication No. 43897/77).

The above-mentioned Bacillus strain No. 13, Bacillus strain No. 17-1, Bacillus strain No. 38-2, Bacillus strain No. 135 and Bacillus strain No. 169 were deposited at Fermentation Research Institute, Agency of Industrial Science and Technology, with FRI Deposition Nos. 611, 612, 614, 617 and 618, respectively.

A product obtained by refining the above-mentioned filtrate with an ion exchange resin and concentrating the refined filtrate is commercially available as a cyclodextrin-containing starch syrup. In the present invention, this starch syrup may be used.

The starch decomposition product containing cyclodextrin is not limited to those obtained according to the above-mentioned method. Any of starch decomposition products containing $\alpha$-cyclodextrin, $\beta$-cyclodextrin, $\gamma$-cyclodextrin or a mixture thereof may be used in the present invention irrespectively of the manufacturing method.

Various methods can be adopted for forming an inclusion compound from petroleum in oil sand and cyclodextrin. For example, there can be mentioned a method comprising mixing oil sand with cyclodextrin under agitation. In practising this method, if cyclodextrin is used singly, a paste or suspension is prepared by adding water or warm water to cyclodextrin (the amount of water or warm water is about 0.1 to about 6 times the amount of cyclodextrin by weight). When the above-mentioned starch decomposition product containing cyclodextrin or the above-mentioned commercially available starch syrup containing cyclodextrin is used, since water is contained in an amount of 70 to 80%, it may be used at it is. Oil sand is added to the above paste or emulsion or the above decomposition product or starch syrup in an amount about 0.1 to about 3 times the amount of cyclodextrin by weight, and the mixture is sufficiently agitated. The mixing operation under agitation is carried out for 30 minutes to 12 hours, preferably 1 to 3 hours. If cyclodextrin or a starch decomposition product containing cyclodextrin is thus added to oil sand and they are sufficiently mixed in the presence of water, petroleum in oil sand is separated from the surface of sand or sand rock by the surface activity of cyclodextrin and transferred into the paste or suspension of cyclodextrin and is intruded into voids in the interior of molecules of cyclodextrin to form an insoluble inclusion compound. Then, the so-formed insoluble inclusion compound alone is recovered by centrifugal separation or other means and intended petroleum can easily be collected by throwing the recovered inclusion compound into warm water or subjecting it to steam distillation. Furthermore, the cyclodextrin left after collection of petroleum can be used for formation of the inclusion compound again. Therefore, the process of the present invention is advantageous from the economical viewpoint.

The present invention will now be described in detail by reference to the following Examples that by no means limit the scope of the present invention.

EXAMPLE I

To 1 Kg of oil sand produced in the district of Alberta, Canada, was added 2 Kg of an aqueous suspension of β-cyclodextrin formed by mixing 500 g of β-cyclodextrin with 1.5 Kg of water under agitation, and the resulting mixture was agitated at room temperature for 1 hour and allowed to stand still for 5 hours. After separation of the precipitated sand and rock, the resulting inclusion compound of petroleum and cyclodextrin was recovered from the suspension by centrifugal separation. Then, the recovered inclusion compound was subjected to steam distillation to obtain about 180 g of petroleum.

Example II

Oil sand was treated in the same manner as described in Example I except that 3.5 Kg a cyclodextrin-containing starch decomposition product obtained according to the method disclosed in Japanese Patent Publication No. 43897/77 was used instead of 2 Kg of the βcyclodextrin suspension used in Example I. Petroleum was obtained in an amount of about 150 g.

Example III

Oil sand was treated in the same manner as described in Example I except that 3 Kg of a cyclodextrin-containing starch syrup (Celdex CH-20 manufactured and sold by Nippon Shokuhin Kako K. K.; cyclodextrin content = 15% by weight) was used instead of 2 Kg of the β-cyclodextrin suspension used in Example I. Petroleum was obtained in an amount of about 150 g.

What is claimed is:

1. A process for the production of oil from oil sand, characterized by adding cyclodextrin or a starch decomposition product containing cyclodextrin to oil sand to convert petroleum in the oil sand to an inclusion compound and separating and collecting petroleum from said inclusion compound.

* * * * *